United States Patent [19]

Jayne

[11] 4,037,906

[45] July 26, 1977

[54] ELECTRICAL CONNECTOR AND CONTACT

[75] Inventor: Max Leroy Jayne, North Warren, Pa.

[73] Assignee: GTE Sylvania Incorporated, Stamford, Conn.

[21] Appl. No.: 669,193

[22] Filed: Mar. 22, 1976

[51] Int. Cl.[2] ..... H01R 13/58

[52] U.S. Cl. ..... 339/107; 339/17 L; 339/206 R

[58] Field of Search ..... 339/107, 206 R, 207 R, 339/208, 17 L, 17 LC, 17 LM, 17 R

[56] References Cited

U.S. PATENT DOCUMENTS

| | | | |
|---|---|---|---|
| 3,155,446 | 11/1964 | Kowaleski et al. | 339/17 LM |
| 3,920,306 | 11/1975 | Barnett, Jr. et al. | 339/107 X |
| 3,951,501 | 4/1976 | Bauerle et al. | 339/107 X |

*Primary Examiner*—Gerald A. Dost
*Assistant Examiner*—DeWalden W. Jones
*Attorney, Agent, or Firm*—Norman J. O'Malley; Lawrence R. Fraley; John C. Fox

[57] ABSTRACT

An electrical connector for electrically interconnecting at least one electrical wire and at least one contacting member within an insulative member. The connector includes an insulative housing, at least one contact having a contacting portion positioned within the housing and a tail portion extending from the housing and adapted for electrically contacting said contacting member, and a pivotally mounted cover means pivoted on one end to the housing and adapted for covering a recessed area within said housing. An electrical contact which may be used in the above connector is also disclosed.

13 Claims, 11 Drawing Figures

Fig. 1
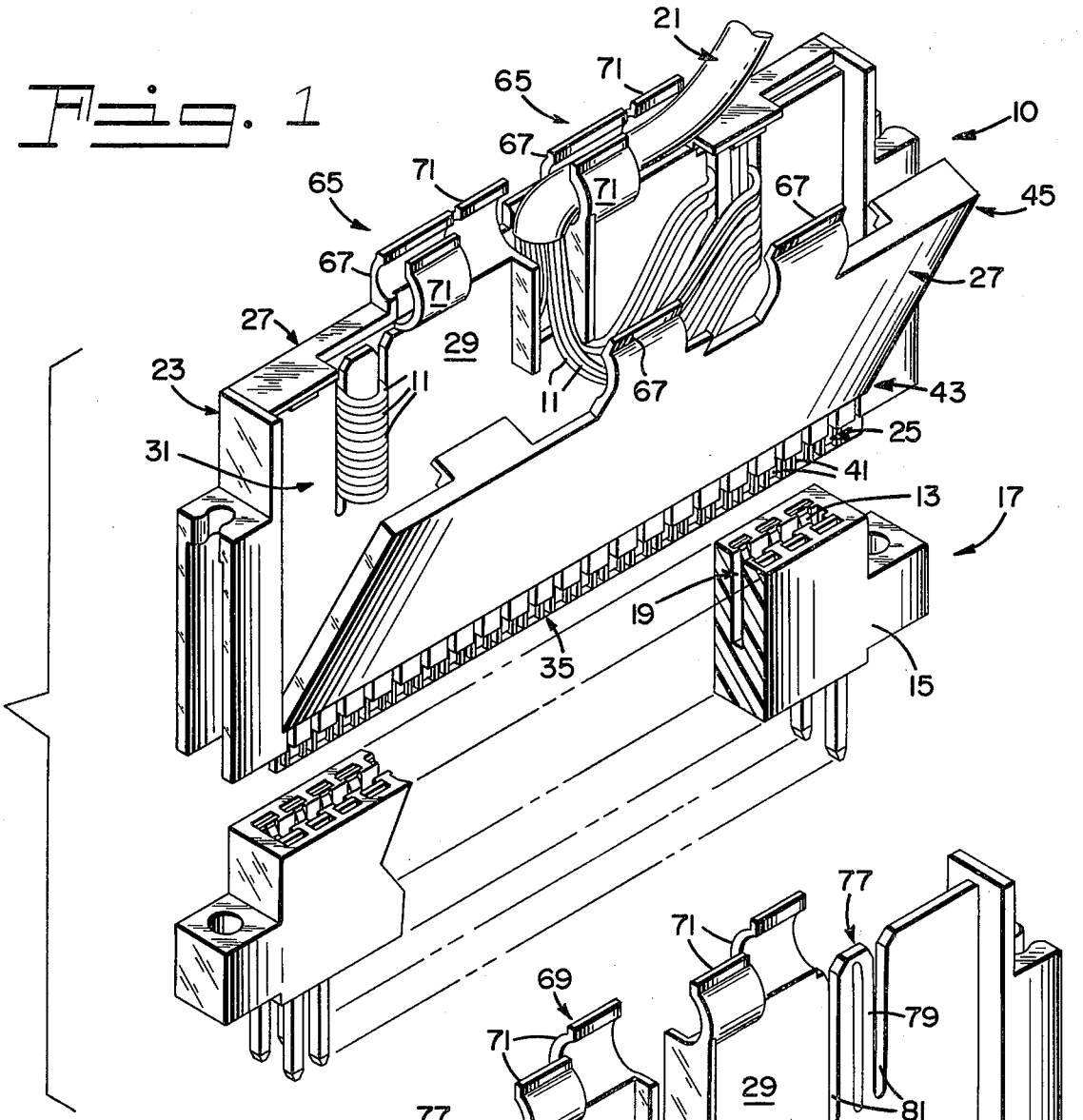
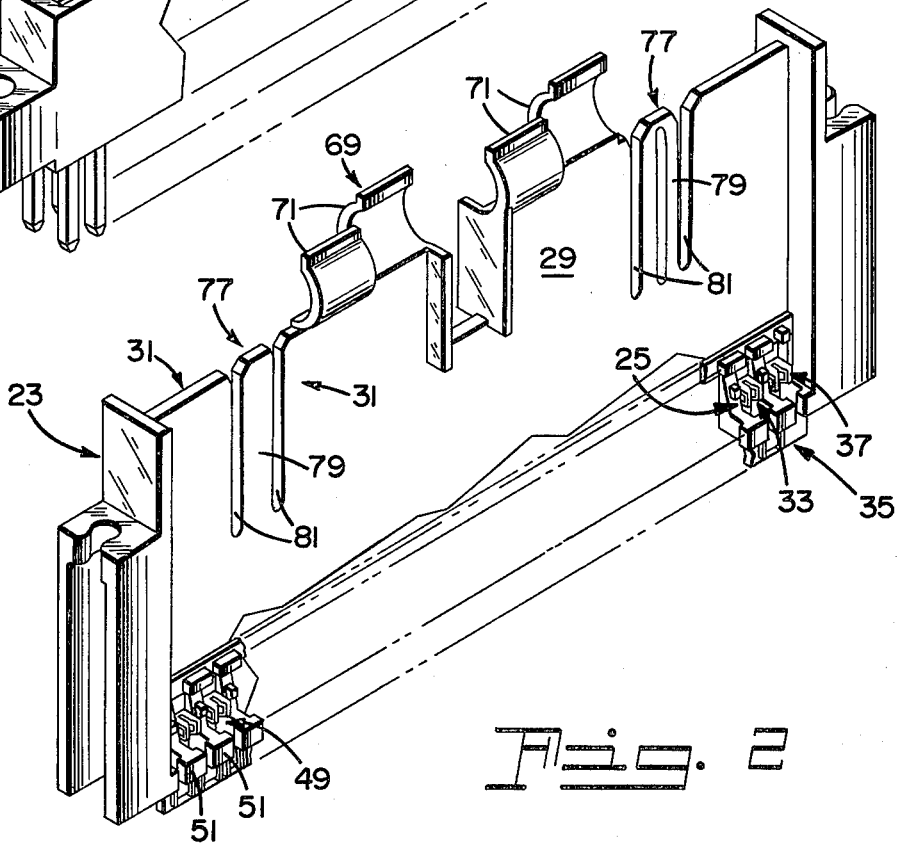
Fig. 2

Fig. 4
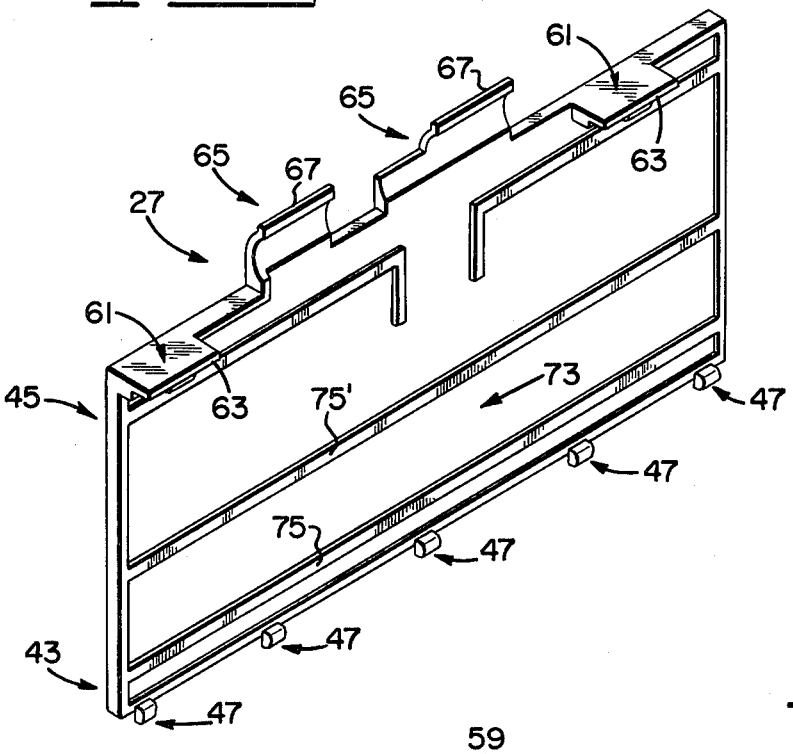
Fig. 5
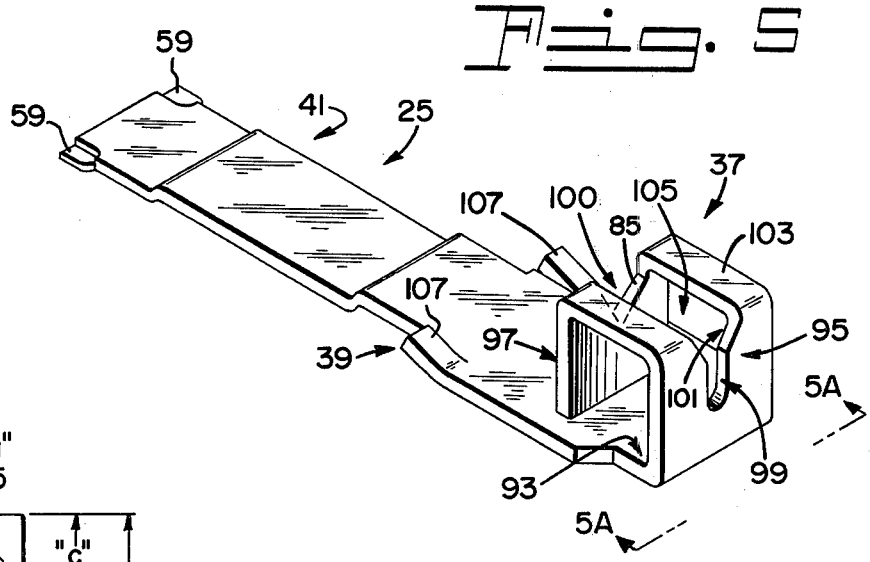
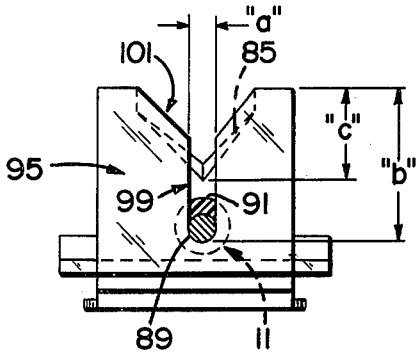
Fig. 5A

ELECTRICAL CONNECTOR AND CONTACT

BACKGROUND OF THE INVENTION

The present invention relates to electrical connectors and more particularly to connectors for electrically interconnecting a first conductive means, e.g. electrical wire, with a second conductive means such as a printed circuit board connector.

Broadly speaking, the invention involves the electrical interconnection of at least one electrical wire with a corresponding contacting member positioned within an insulative member. As stated, an example of this contacting member-insulative member arrangement is a printed circuit board (PCB) connector. Most PCB connectors include a plurality of individual electrical contacts spacedly positioned within an insulative housing adjacent a printed circuit board receiving slot. When the board is inserted within the slot, the contacts normally engage designated conductive paths on the board. Because the tail portions of the contacts are electrically joined to an external conductive means, e.g. electrical wiring, the PCB connector serves as an interconnection between the board and wiring.

As will be described, the connector of the present invention is adapted for being positioned within and electrically contacting a contacting member-insulative member component such as a PCB connector. The connector of the invention is also adapted for securing and electrically contacting at least one electrical wire. Accordingly, the invention provides a means for electrically interconnecting ths wire with the contacting member positioned within said insulative member. In the particular case of PCB connectors wherein the connector's contact tail portions are joined to electrical wiring, the present invention assures a unique means for electrically joining a first plurality of wires with the second plurality of wires joined to said tail portions. This interconnection is achieved without the necessity of several relatively complex wiring operations heretofore required in the prior art.

It is therefore believed that an electrical connector capable of interconnecting at least one electrical wire with at least one contacting member positioned within an insulative housing, e.g. a PCB connector, would constitute a significant advancement in the art. It is further believed that a new electrical contact, capable of being utilized within the connector as defined above, would also constitute an advancement in the art.

OBJECTS AND SUMMARY OF THE INVENTION

It is a primary object of the invention to enhance the electrical connector art.

It is another object of the present invention to provide an electrical connector adapted for electrically interconnecting at least one electrical wire with at least one contacting member located within an insulative member, an example of such a contacting member-insulative member assembly being a typical printed circuit board connector.

It is still another object of the invention to provide an electrical contact which may be used in the above connector.

In accordance with one aspect of the invention there is provided an electrical connector for electrically interconnecting at least one electrical wire and at least one electrical contacting member positioned within an insulative member. The connector comprises an electrically insulative housing comprising a body portion and at least one contact receiving portion, and an extending portion extending from the body portion, at least one electrical contact including a contacting portion, a retention portion, and a tail portion, and a cover means including first and second opposing end portions, one of said end portions pivotally mounted on the housing.

In accordance with another aspect of the invention there is provided an electrical contact for contacting an electrical wire having a substantially round conductive portion, said contact comprising a contacting portion including a base portion and first and second opposingly positioned and substantially upstanding sides, each of the sides having an opening therein. The width of the slotted opening within the first side is substantially uniform and equal to or less than the diameter of the wire's conductive portion. The opening within the second side includes a substantially V-shaped angular edge portion, the depth of said edge portion less than the depth of said slotted opening. The contact further comprises a retention portion substantially adjacent said contacting portion, and a tail portion substantially adjacent the retention portion.

BRIEF DESCRIPTION OF THE DRAWINGS

FIG. 1 is an isometric view of a preferred embodiment of the connector of the invention;

FIG. 2 is an isometric view of the housing of the connector of FIG. 1;

FIG. 4 is an isometric view of one embodiment of a cover means for the invention;

FIG. 5 is an isometric view of a preferred embodiment for the contact of the invention;

FIG. 5A is an end view taken along the line 5A—5A in FIG. 5;

.

DETAILED DESCRIPTION OF THE PREFERRED EMBODIMENTS

Figure 6:
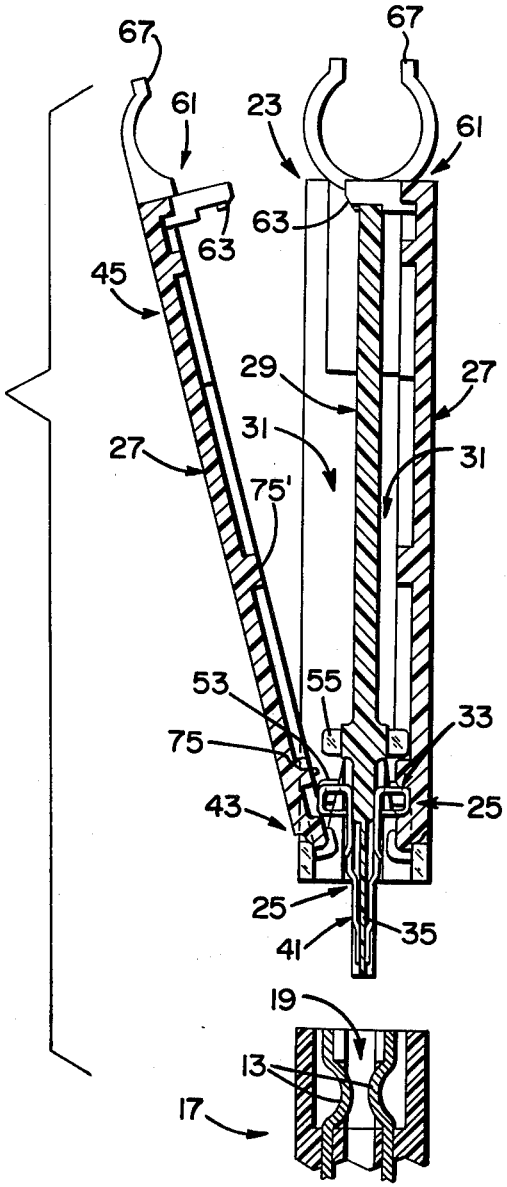
FIG. 6 is an end elevational view of the connector of FIG. 1.

For a better understanding of the present invention, together with other and further objects, advantages and capabilities thereof, reference is made to the following disclosure and appended claims in connection with the above-described drawings.

With reference to FIG. 1, there is shown an electrical connector 10 in accordance with a preferred embodiment of the invention. Connector 10 is adapted for electrically interconnecting at least one electrical wire 11 with at least one electrical contacting member 13 positioned within an insulative member 15, a typical example of such a contacting member-insulative member assembly being a printed circuit board (PCB) connector 17. As will be described, connector 10 is adapted for being positioned within the PCB connector's board receiving slot 19.

Although the present invention is defined in its broader aspects as connecting aspects as connecting at least one wire 11 with a corresponding contacting member 13, a preferred usage for connector 10 is to electrically interconnect a plurality of electrical wires 11 positioned within a cable 21 or similar sheath member with a corresponding plurality of contacting members 13 spacedly positioned in insulative member 15. As will also be described, connector 10 is capable of connecting contacts 13 positioned in opposingly oriented rows within member 15.

Connector 10 comprises an electrically insulative housing 23, at least one electrical contact 25, and at least one cover means 27. When contacting a plurality of wires 11 to a PCB connector 17 having a plurality of contacting members, it is understood that connector 10 includes a corresponding plurality of contacts 25.

Insulative housing 23 comprises a body portion 29 which includes at least one recessed area 31 therein. In the embodiment shown in FIGS. 1 and 2, body portion 29 includes two such recessed areas. Recessed area 31 is adapted for having wire 11 located therein. When connecting a plurality of wires 11 and incorporating two recessed areas 31, it is shown in FIG. 1 that some of the wires 11 are located withn one recessed area 31 while the remaining wires are substantially located within the other area 31 positioned on the opposing side of body portion 29.

Housing 23 also includes at least one contact receiving portion 33 (shown in FIGS. 2 and 3) positioned relative to recessed portion 31. It is understood that housing 23 includes one contact receiving portion 33 for each of the contacts 25 within connector 10. Housing 23 further includes an extending portion 35 extending from body portion 29. As shown in FIG. 6, extending portion 35 is adapted for being positioned within slot 19 of PCB connector 17.

Each of the electrical contacts of connector 10 comprises a contacting portion 37 (FIGS. 2 and 3), a retention portion 39, and a tail portion 41. Reference is also called to FIG. 5 for a more detailed view of contact 25.

Contacting portion 37 is adapted for being positioned within contact receiving portion 33 of housing 23 and is further adapted for having one of the electrical wires 11 positioned therein. As will be described, complete positioning of wire 11 within contacting portion 37 assures electrical contact between the conductive portion of the wire and the contacting portion.

Retention portion 39 of contact 25 is positioned adjacent contacting portions 37 and is adapted for retaining portion 37 within contact receiving portion 33. Tail portion 41 is positioned adjacent retention portion 39 and is adapted for electrically contacting the corresponding contacting member 13 within PCB connector 17 when extending portion 35 of housing 23 is positioned therein. As illustrated in FIG. 6, tail portion 41 extends from body portion 29 of housing 23 in engaged relationship to extending portion 35 of said housing.

Figure 7:
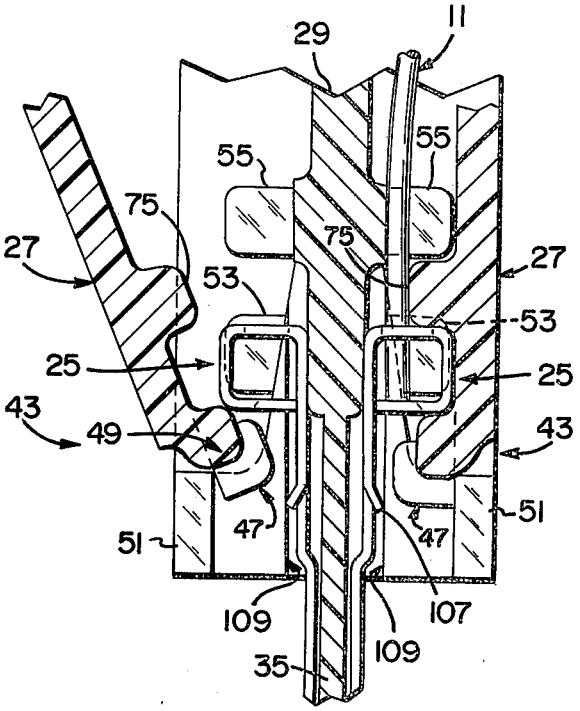
FIG. 7 is an enlarged end elevational view of the pivotal arrangement of the cover means and housing of the connector of FIG. 1.

Cover means 27 of connector 10 comprises first and second opposing end portions 43 and 45, respectively. Although only one cover means 27 is required in accordance with the broad aspect of the invention, connector 10 preferably comprises two such members. This is preferred when using a housing 23 which includes two recessed areas 31 for housing a plurality of wires 11. Each cover 27 is pivotally mounted within housing 23 in the region substantially adjacent contact receiving portion 33. More specifically, first end portion 43 is pivotally mounted therein. Second opposing end portion 45 of cover 27 is thereby adapted for substantially covering one of the recessed areas 31. By doing so, cover means 27 substantially covers the portion of wires 11 located within the recessed area. In FIGS. 6 and 7 one of the covers 27 is shown in the closed position while the opposing cover 27 is shown in the open position. Electrical wires 11 are removed from FIG. 6 for reasons of clarity. In FIG. 7, one wire 11 is shown positively secured within housing 23 by the closed cover 27.

Figure 3:
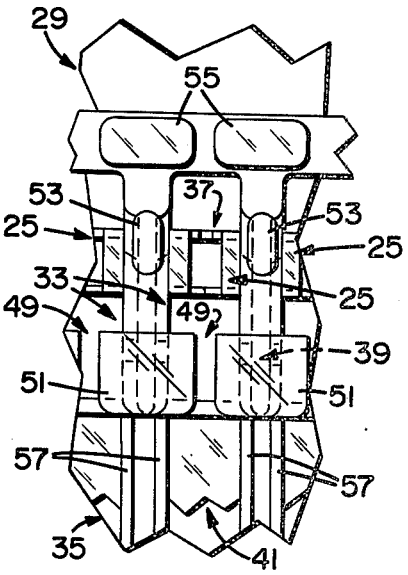
FIG. 3 is an enlarged side view illustrating the positioning relationship of the preferred contact of the invention within the housing of FIG. 2.

First opposing end 43 of cover means 27 is provided with a pivot portion 47 which pivotally mounts within a corresponding recess 49 defined within contact receiving portion 33. Recess 49 is also illustrated in FIGS. 2 and 3 with the corresponding cover 27 removed for clarification. Although a recess 49 is defined by each of the contact receiving portions 33 of the invention, it is understood that first opposing end 43 of each cover 27 need only two pivot portions 47 to provide the described pivotal motion. As is further understood, several such pivot portions 47 can be provided on each of the covers 27, depending on the length of the cover member and corresponding body portion 29.

As stated, each recess 49 is defined within each of the contact receiving portions 33. Each contact receiving portion 33 in turn is defined by a pair of opposing upstanding first boss portions 51 (reference particularly FIGS. 3 and 7) a pair of opposing upstanding second boss portions 53, and a pair of opposing upstanding third boss portions 55. Each of the above boss portions are also adapted for aligning with various upstanding parts of first end 43 of cover 27 in a manner to be described. With reference to FIG. 3, extending portion 35 is shown as it extends below body portion 29 of housing 23. It is also shown that first boss portions 51 are positioned at the lowermost portion of body 29.

To assure alignment of tail portions 41 of each of the contacts 25 within connector 10, extending portion 35 includes a plurality of elongated rib members 57. Two opposing ribs 57 are provided for each tail 41 in the manner shown in FIG. 3. As illustrated, each tail portion aligns with the respective pair of ribs 57 and is adapted for slidably engaging said members. This positioning relationship assures a means whereby tail portions 41 will not be laterally displaced during positioning of connector 10 within PCB connector 17. To further assure this alignment, tail portion 41 includes a pair of extending retention arms 59 (shown in FIG. 5), each of which are adapted for providing an interference fit between the tail portion and the adjacent ribs 57. This relationship in turn is specifically designed to prevent outward displacement of the tail portions away from extending portion 35 during positioning of connector 10 in PCB connector 17.

With reference to FIGS. 4 and 6, a preferred embodiment for one of the cover means 27 is shown. Cover 27 is shown as comprising the first and second opposing end portions 43 and 45, respectively. First end 43 is also shown as having the aforementioned pivot portions 47. A total of five such members are illustrated as being spacedly positioned along end portion 43. Second end 45 preferably includes latching means 61 thereon, said means 61 comprising a pair of extending latch members 63 which are adapted for positively engaging body portion 29 when the cover 27 is closed over recessed area 31.

Second end 45 also includes first alignment means 65 which assists in aligning cable 21 within connector 10. As shown in FIG. 1, each of the cover members 27 include first alignment means 65, each preferably in the form of two aligning tabs 67. When the covers 27 are closed on body portion 29, tabs 67 align with a corresponding second alignment means 69 located on body portion 29. As shown in FIG. 2, second alignment means 69 preferably comprises four aligning tabs 71 substantially similar to tabs 67 on covers 27. When the connector is in the closed position, the above aligning tabs align in such a manner that cable 21 may be positioned atop connector 10 in one of two ways. The cable can be positioned in the manner indicated in FIG. 1 or it can be positioned from an opposing direction.

Cover means 27 further includes a first strain relief means 73 for relieving tensile strain on wire 11 when the wire is positioned within contact 25. First relief means 73 preferably comprises an elongated upstanding member 75 which is adapted for engaging wire 11 to force the wire against body portion 29 of housing 23 when second end 45 of cover 27 covers recessed area 31. Attention is called to FIG. 7 where this relationship is fully shown. First strain relief means 73 may also include a second upstanding elongated member 75' which positively engages wire 11 in the same manner as that of member 75.

Body portion 29 of housing 23 also preferably includes a second means 77 for relieving tensile strain on wire 11. As illustrated in FIGS. 1 and 2, second strain relief means 77 comprises at least one rib member 79 having an open portion 81 on each side thereof. When incorporating a plurality of wires 11 within connector 10, two ribs 79 are preferably utilized. Strain relief is thus provided by each of these members when the wiring is wound thereabout in the circuitous manner shown in FIG. 1. Thus it can be seen that at least two strain relief means can be provided for wiring 11 when the wires are properly oriented within connector 10. The first strain relief 73 serves primarily to relieve tensile strain on the portion of the wire positioned in contacting portion 37 of contact 25 while second strain relief means 77 primarily serves to relieve tensile strain on cable 21. As shown however, relief means 77 also serves to relieve tensile strain on the portion of wire 11 within contacting portion 37 of the contact.

Figure 8:
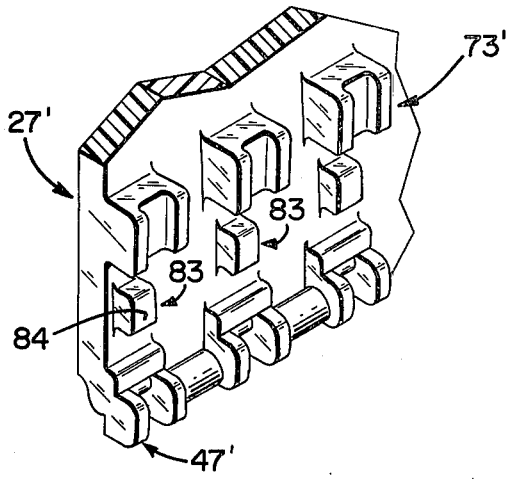
FIG. 8 is an enlarged isometric view of an alternate embodiment of a cover means for the invention.
Figure 9:
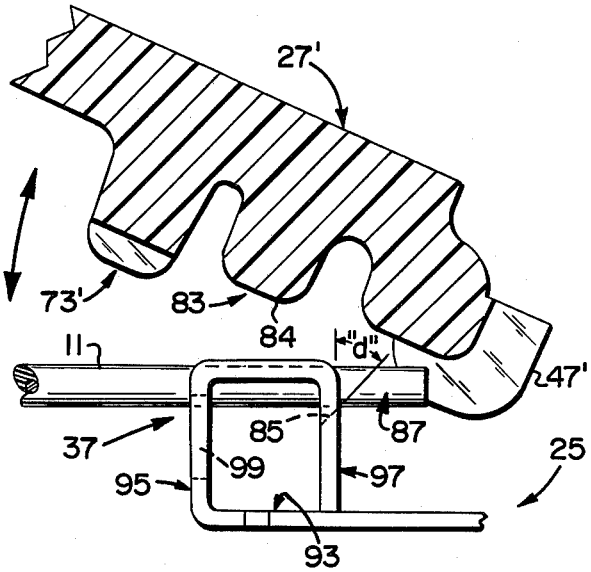
FIGS. 9 and 10 represent a sequence of operation for severing an electrical wire within the contact of the invention using the cover means of FIG. 8.
Figure 10:
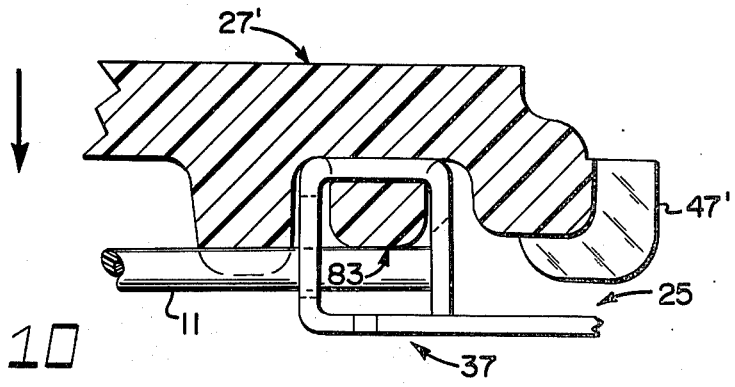

In FIG. 8 there is shown an alternate embodiment of a cover means for use with the present invention. As will be described, alternate cover 27' includes means for providing severance of wire 11 once the wire is initially positioned within contacting portion 37 of electrical contact 25. Severance of wire 11 is achieved when cover 27' is closed on housing 23 to cover recess 31. As further understood, cover 27' also provides complete positioning of wire 11 within contacting portion 37. During said closing, an actuating means 83, preferably in the form of a protruding boss member 84, positively engages wire 11 when the wire is first oriented within contacting portion 37 of contact 25. This first orientation is illustrated in FIG. 9. The pivotal closing of cover 27' thus causes boss 84 to force wire 11 downward onto a substantially V-shaped angular edge 85 provided on contacting portion 37. Angular edge 85 thus cuts an end segment 87 from wire 11.

In FIG. 8, alternate cover 27' is also shown as including pivot portions 47' and first strain relief means 73, said components acting in the same manner as their counterparts on cover 27.

Thus it can be seen that the connector of the invention includes several important features which facilitate positioning and retention of electrical wiring therein. By use of pivoting cover members, the connector also provides for ease of repair and replacement of said wiring.

With reference to both FIGS. 5 and 5A, the preferred electrical contact of the invention is shown. As stated previously, contact 25 includes a contacting portion 37, a retention portion 39 substantially adjacent contacting portion 37, and a tail portion 41 adjacent retention portion 39. Contact 25, preferably of one-piece construction, is particularly adapted for electrically contacting an electrical wire 11 having a substantially round electrically conductive portion 89 and a portion of electrically insulative material 91 thereabout.

Contacting portion 37 includes a base portion 93 and first and second opposingly positioned and upstanding sides 95 and 97, respectively. First side 95 includes therein a slotted opening 99 having a substantially uniform width (indicated as *a* in FIG. 5A). Width *a* is equal to or less than the corresponding diameter for conductive portion 89 of wire 11. Thus, when wire 11 is positioned within slotted opening 99, insulative material 91 will be stripped therefrom and conductive portion 89 will electrically engage the sides of opening 99.

Slotted opening 99 is shown as being of a predetermined depth *b* within first side 95. Preferably, this depth extends approximately the full length of side 95 to assure a more positive seat of wire 11 within opening 99.

Second side 97 includes therein an opening 100 including the aforementioned substantially V-shaped angular edge portion 85, the purpose of said edge to sever an end segment of wire 11. In the preferred contact of the invention, the depth *c* of angular edge 85 is less than the corresponding depth *b* for opening 99. The illustrated comparative relationship between these depths assures a means whereby positive stripping of the wire's insulation material will occur after any undesired end segment of the wire has been removed.

To facilitate first orientation of wire 11 within contacting portion 37, slotted opening 99 is provided with an upper tapered portion 101. Tapered portion 101 initially retains wire 11 prior to the aforementioned severance procedure.

Although there has been shown (in FIG. 8) means for assisting in the severance and completed seating of wire 11, it is fully understood that other means are possible for accomplishing this operation. In the event that a cover is employed which does not include the unique actuating means 83 depicted in FIG. 8, a bladed tool member such as a screwdriver may be used to engage wire 11 and force it down onto edge 85 and into slotted opening 99.

In FIG. 5, contacting portion 37 is shown as being of a substantially closed loop configuration. This configuration is preferably rectangular in cross-section and includes a substantially flat member or portion 103 which interconnects sides 95 and 97. Within flat portion 103 is shown an elongated opening 105 which extends across portion 103 and interconnects the openings within sides 95 and 97. Thus, when wire 11 is first positioned within contacting portion 37, it is oriented within opening 105.

The preferred angle (*d* in FIG. 9) for edge 85 is approximately 45° with upstanding side 97. It is understood, of course, that angle *d* can form almost any acute angle with side 97.

The retention portion 39 of contact 25 is shown as including at least two protruding tip members 107. Each of these members provides spring-like retention action to assist in retaining contacting portion 37 within an electrical component such as connector 10. In the particular embodiment of the invention as shown in FIG. 7, two grooves 109 are provided within the connector's contact receiving portion 33. Accordingly, each of the tip members 107 is adapted for being slidably oriented within one of these grooves to engage the walls thereof. Positioning of tips 107 within grooves 109 depresses the tips to effect a spring-action type retention between retention portion 39 and the walls of grooves 109.

Thus there has been shown and described an electrical connector and contact which provide several new features over prior art devices. The key features of the invention, as described, provide for facile placement and severance of electrical wiring within these components. Further, it has been shown and described that repair and replacement of this wiring has been facilitated. The connector of the invention is particularly adapted for use with a typical printed circuit board connector, thus providing a new usage for these devices.

While there has been shown and described what are at present considered the preferred embodiments of the invention, it will be obvious to those skilled in the art that various changes and modifications may be made therein without departing from the scope of the invention as defined by the appended claims.

What is claimed is:

1. An electrical connector for electrically interconnecting at least one electrical wire and at least one electrical contacting member positioned within an insulative member, said connector comprising:

an electrically insulative housing comprising a body portion including at least one recessed area therein adapted for having said wire located therein and at least one contact receiving portion positioned relative to said recessed area, and an extending portion extending from said body portion;

at least one electrical contact comprising a contacting portion positioned within said contact receiving portion of said housing for electrically contacting said wire when said wire is positioned therein, a retention portion adjacent said contacting portion for retaining said contacting portion of said contact within said contact receiving portion of said housing, and a tail portion adjacent said retention portion and adapted for electrically contacting said contacting member within said insulative member, said tail portion extending from said body portion of said housing in an engaged relationship to said extending portion of said housing; and at least one cover means comprising first and second opposing end portions, said first end portion pivotedly mounted on said housing in the region substantially adjacent said contact receiving portion, said second end portion adapted for covering said recessed area of said housing, said second end portion including latching means for positively engaging said body portion of said insulative housing to latch said second end portion to said housing;

characterized in that said cover means includes first strain relief means for relieving tensile strain on said electrical wire when said wire is positioned within said contacting portion of said electrical contact.

2. The electrical connector according to claim 1 wherein said first strain relief means comprises at least one upstanding member on said cover means, said upstanding member adapted for engaging said wire to force said wire against said body portion of said housing when said second end portion of said cover means covers said recessed area of said housing.

3. The electrical connector according to claim 1 wherein said body portion of said insulative housing includes second strain relief means therein for relieving tensile strain on said electrical wire when said wire is positioned within said contacting portion of said electrical contact.

4. The electrical connector according to claim 1 wherein said second strain relief means comprises at least one rib member having an open portion on each side thereof, said rib member providing strain relief for said wire when said wire is wound about said rib member in a circuitous manner.

5. The electrical connector according to claim 1 further including wire severance means for severing said wire when said wire is positioned substantially within said contacting portion of said electrical contact.

6. The electrical connector according to claim 1 wherein said wire severance means comprises a substantially V-shaped angular edge portion on said contacting portion of said contact and actuating means on said first end portion of said cover means, said actuating means adapted for engaging said wire positioned substantially within said contacting portion of said contact to force said wire onto said angular edge portion during the pivotal movement of said cover means.

7. An electrical contact for electrically contacting an electrical wire having a substantially round conductive portion and an insulative portion about said conductive portion, said contact comprising:

a contacting portion including a base portion and first and second opposingly positioned and upstanding sides, said first side having a slotted opening therein of a substantially uniform width and a predetermined depth, said uniform width equal to or less than the diameter of said substantially round conductive portion of said wire, a retention portion substantially adjacent said contacting portion; and a tail portion substantially adjacent said retention portion; and characterized in that the second side of the base portion of the contacting portion has an opening therein including a substantially V-shaped angular edge portion, the depth of said angular edge portion less than said predetermined depth of said slotted opening in said first side.

8. The electrical contact according to claim 7 wherein said contacting portion is of a substantially closed loop configuration.

9. The electrical contact according to claim 8 wherein said closed loop configuration is substantially rectangular in cross-section and includes a substantially flat portion interconnecting said first and second sides, said flat portion having an elongated opening extending thereacross and interconnecting said openings within said first and second upstanding sides.

10. The electrical contact according to claim 7 wherein the angle of said V-shaped angular edge portion is about 45° with said second upstanding side.

11. The electrical contact according to claim 7 wherein said slotted opening within said first upstanding side extends substantially the full length of said upstanding side.

12. The electrical contact according to claim 7 wherein said retention portion includes at least two protruding tip members.

13. The electrical contact according to claim 7 wherein said contact is of one-piece construction.

* * * * *